US012760915B2

(12) United States Patent
Yu et al.

(10) Patent No.: US 12,760,915 B2
(45) Date of Patent: Oct. 13, 2026

(54) HUMIDIFYING DEVICE

(71) Applicant: QINGDAO HISENSE HITACHI AIR-CONDITIONING SYSTEMS CO., LTD., Qingdao (CN)

(72) Inventors: Detong Yu, Qingdao (CN); Yong Du, Qingdao (CN); Chuanyong Liu, Qingdao (CN); Chuan Li, Qingdao (CN); Qinghao Meng, Qingdao (CN)

(73) Assignee: QINGDAO HISENSE HITACHI AIR-CONDITIONING SYSTEMS CO., LTD., Qingdao (CN)

( * ) Notice: Subject to any disclaimer, the term of this patent is extended or adjusted under 35 U.S.C. 154(b) by 427 days.

(21) Appl. No.: 18/468,152

(22) Filed: Sep. 15, 2023

(65) Prior Publication Data

US 2024/0003557 A1 Jan. 4, 2024

Related U.S. Application Data

(63) Continuation of application No. PCT/CN2021/098916, filed on Jun. 8, 2021.

(30) Foreign Application Priority Data

Mar. 24, 2021 (CN) ..... 202110314159.0
Mar. 24, 2021 (CN) ..... 202110314355.8

(51) Int. Cl.
*F24F 6/04* (2006.01)
*F24F 13/20* (2006.01)
*F24F 6/00* (2006.01)

(52) U.S. Cl.
CPC ..... *F24F 6/04* (2013.01); *F24F 13/20* (2013.01); *F24F 2006/006* (2013.01); *F24F 2006/008* (2013.01)

(58) Field of Classification Search
CPC ..... F24F 6/04; F24F 13/20; F24F 2006/006; F24F 2006/008; F24F 2110/20; F24F 6/00; F24F 13/08
See application file for complete search history.

(56) References Cited

U.S. PATENT DOCUMENTS 2,947,452 A * 8/1960 Frohmader ..... F24F 6/04 261/106
3,075,750 A * 1/1963 Goettl ..... F24F 6/04 55/491

(Continued)

FOREIGN PATENT DOCUMENTS

AU 2008202357 A1 12/2009
CA 2357364 A1 3/2002

(Continued)

OTHER PUBLICATIONS

EPO translation of CN106288102 (Year: 2017).*

(Continued)

*Primary Examiner* — Stephen Hobson
(74) *Attorney, Agent, or Firm* — MH2 Technology Law Group LLP

(57) ABSTRACT

A humidifying device includes a housing, a humidifying module, and a water spray module disposed above the wet membrane assembly. The housing includes an air inlet, an air outlet, and an installation socket at an end of the housing. The humidifying module includes a water receiving portion and a wet membrane assembly disposed in the water receiving portion, and the water receiving portion is disposed in the installation socket in a pluggable manner. The wet membrane assembly includes a water receiving tray on a top thereof, and the water receiving tray includes a plurality of first through holes. The water spray module includes a water spray board, a water spray cover, and a water inlet assembly connected with the water spray cover. A water storage chamber exits between the water spray board and the water spray cover. The water spray board includes a plurality of second through holes.

18 Claims, 11 Drawing Sheets

(56) References Cited

U.S. PATENT DOCUMENTS 3,179,386 A * 4/1965 Liebmann ..... F24F 6/04 261/142
3,322,405 A * 5/1967 Knudson ..... F24F 6/04 261/106
3,497,188 A * 2/1970 Mcduffee ..... F24F 6/04 261/106
4,158,679 A * 6/1979 Yeagle ..... F24F 6/04 261/106
4,354,985 A * 10/1982 Johnson ..... F24F 6/04 261/DIG. 15
4,419,300 A * 12/1983 VanNess ..... F28F 21/067 62/304
4,499,031 A * 2/1985 Sexton ..... B01F 23/215 261/DIG. 34
5,015,420 A * 5/1991 Jones ..... B01F 23/215 261/106
5,162,088 A * 11/1992 Peng ..... F24F 6/043 261/107
5,620,503 A * 4/1997 Miller ..... F24F 6/14 261/98
5,783,117 A * 7/1998 Byassee ..... F24F 6/043 261/107
5,971,366 A * 10/1999 Smith ..... F24F 6/043 261/36.1
5,971,370 A * 10/1999 Galabinski ..... F28D 5/02 261/106
6,149,141 A * 11/2000 Birdsell ..... F24F 6/043 261/106
6,367,782 B1 * 4/2002 Guetersloh ..... F28D 5/02 261/106
6,824,126 B2 * 11/2004 Keller ..... F24F 6/043 261/106
7,100,906 B2 * 9/2006 Kucera ..... F24F 1/0007 261/106
7,350,364 B2 * 4/2008 Meerpohl ..... A01K 1/0082 62/310
9,593,860 B1 * 3/2017 Robinson ..... F24F 6/00
12,013,150 B2 * 6/2024 Kim ..... F24F 6/04
2002/0070465 A1 * 6/2002 Harvel ..... F24F 6/04 261/36.1
2003/0183955 A1 * 10/2003 Fields ..... F23D 14/68 261/106
2008/0000253 A1 * 1/2008 Kim ..... F24F 1/022 62/291
2010/0133707 A1 * 6/2010 Huang ..... A61L 9/20 422/4
2010/0243432 A1 * 9/2010 Ikemizu ..... F24F 6/043 422/186
2011/0005261 A1 * 1/2011 Lee ..... A61L 9/22 165/59
2011/0068486 A1 * 3/2011 Quam ..... F24F 6/043 236/51
2011/0068489 A1 * 3/2011 Terlson ..... F24F 11/30 261/106
2011/0068491 A1 * 3/2011 Wang ..... F24F 6/04 261/103
2011/0291533 A1 * 12/2011 Mcfarland ..... F24F 13/20 312/236
2012/0234166 A1 * 9/2012 Markham ..... F24F 6/18 95/149
2012/0241987 A1 * 9/2012 Lee ..... F24F 6/043 261/107
2013/0106004 A1 * 5/2013 Stumphauzer ..... F24F 6/04 261/127
2013/0175711 A1 * 7/2013 Nutter ..... C02F 1/32 210/748.11
2013/0186611 A1 * 7/2013 Schneider ..... F24F 6/043 236/44 A
2015/0308732 A1 * 10/2015 Lee ..... F24F 3/14 62/291
2015/0330643 A1 * 11/2015 Lee ..... F24F 6/06 210/243
2016/0010882 A1 * 1/2016 Lee ..... A47B 81/00 312/236
2016/0305675 A1 * 10/2016 Terlson ..... F24F 6/04
2017/0153040 A1 * 6/2017 Wang ..... F24F 13/28
2017/0227243 A1 * 8/2017 Thomas ..... F24F 5/0035
2017/0356663 A1 * 12/2017 Couperthwaite ..... F28F 13/06
2018/0172300 A1 * 6/2018 Conrad ..... F24F 1/0087
2019/0231912 A1 * 8/2019 Dobrinsky ..... A61L 2/10
2019/0242595 A1 * 8/2019 Eplee ..... F24F 13/30
2019/0277519 A1 * 9/2019 Petersen ..... B01F 23/215
2019/0323730 A1 * 10/2019 Bang ..... F24F 1/0063
2021/0055008 A1 * 2/2021 Kim ..... F24F 13/20

FOREIGN PATENT DOCUMENTS

CA 2379280 A1 11/2002
CA 2421357 A1 9/2003
CN 2847125 Y 12/2006
CN 200996699 Y 12/2007
CN 101107481 A * 1/2008 ..... F24F 3/14
CN 101749820 A * 6/2010 ..... F24F 6/043
CN 101749821 A * 6/2010 ..... F24F 6/00
CN 103912950 A 7/2014
CN 104380000 A * 2/2015 ..... F24F 11/0008
CN 104676768 A 6/2015
CN 104833018 * 8/2015
CN 104896596 A * 9/2015 ..... F24F 3/14
CN 105444269 A * 3/2016 ..... F24F 6/04
CN 205299810 U 6/2016
CN 106091277 A * 11/2016 ..... F24F 11/62
CN 106288102 * 1/2017
CN 106288102 A 1/2017
CN 106679032 A * 5/2017 ..... F24F 6/04
CN 206191794 U 5/2017
CN 107345701 A * 11/2017 ..... F24F 13/28
CN 107667261 A * 2/2018 ..... F24F 6/04
CN 207962906 U 10/2018
CN 208075129 U 11/2018
CN 108954557 A 12/2018
CN 109253516 A * 1/2019 ..... F24F 5/0003
CN 109592645 A * 4/2019 ..... C01B 13/0259
CN 110160189 A * 8/2019 ..... F24F 6/00
CN 110213927 A 9/2019
CN 110296516 A 10/2019
CN 110529956 * 12/2019
CN 110749015 A 2/2020
CN 110762637 A * 2/2020 ..... F24F 11/85
CN 210220128 U 3/2020
CN 210861396 U 6/2020
CN 211503107 U 9/2020
CN 111947285 A * 11/2020 ..... F24F 11/89
CN 112240620 A * 1/2021 ..... F24F 3/14
CN 216048054 U * 3/2022
CN 216693783 U * 6/2022
CN 218120009 U * 12/2022
CN 221005333 U * 5/2024
KR 20030010814 A * 2/2003
KR 101403960 B1 * 6/2014 ..... F24F 6/14
WO WO-2015146050 A1 * 10/2015 ..... F24F 6/04
WO WO-2015170415 A1 * 11/2015 ..... F24F 13/222
WO WO-2016098791 A1 * 6/2016 ..... F24F 6/00
WO WO-2016181535 A1 * 11/2016 ..... F24F 11/89
WO WO-2018165793 A1 * 9/2018 ..... F24F 8/22
WO WO-2020220614 A1 * 11/2020 ..... F24F 11/70

OTHER PUBLICATIONS

EPO translation of CN110529956 (Year: 2019).*
EPO translation of CN104833018 (Year: 2015).*
International Search Report and Written Opinion dated Dec. 17, 2021 in corresponding International Application No. PCT/CN2021/098916, translated, 14 pages.
Chinese Notification of the First Office Action dated Mar. 23, 2022 in corresponding Chinese Application No. 202110314159.0, translated, 20 pages.
Chinese Notification of the First Office Action dated Mar. 23, 2022 in corresponding Chinese Application No. 202110314355.8, translated, 16 pages.

(56) References Cited

OTHER PUBLICATIONS

Chinese First Office Action dated Aug. 26, 2025 in corresponding Chinese Application No. 202310639938.7, translated, 14 pages.
First Chinese Office Action dated Feb. 13, 2026 in corresponding Chinese Application No. 202180064344.7, translated, 17 pages.

* cited by examiner

HUMIDIFYING DEVICE

CROSS-REFERENCE TO RELATED APPLICATIONS

This application is a continuation application of International Patent Application No. PCT/CN2021/098916, filed on Jun. 8, 2021, which claims priority to Chinese Patent Application No. 202110314159.0, filed on Mar. 24, 2021, and Chinese Patent Application No. 202110314355.8, filed on Mar. 24, 2021, which are incorporated herein by reference in their entireties.

TECHNICAL FIELD

The present disclosure relates to the technical field of household appliances, and in particular, to a humidifying device.

BACKGROUND

Humidifiers are household appliances commonly used in people's daily life, and central humidifiers installed by ceiling suspension are widely popularize and used due to their strong humidifying ability. The central humidifier is usually installed hidden in the suspended ceiling and uses tap water for water supply and sends air to various areas of the house through air ducts, so as to achieve humidification for the whole house.

SUMMARY

A humidifying device is provided. The humidifying device includes a housing, a humidifying module, and a water spray module. The housing includes an air inlet, an air outlet, and an installation socket disposed at an end of the housing. The humidifying module includes a water receiving portion and a wet membrane assembly. The wet membrane assembly is disposed in the water receiving portion, and the water receiving portion is disposed in the installation socket in a pluggable manner. The wet membrane assembly includes a water receiving tray on a top thereof, and the water receiving tray includes a plurality of first through holes. The water spray module is disposed above the wet membrane assembly. The water spray module includes a water spray board, a water spray cover disposed on the water spray board, and a water inlet assembly connected with the water spray cover. A water storage chamber exits between the water spray board and the water spray cover. The water spray board includes a plurality of second through holes. The wet membrane assembly is located in the housing, and the wet membrane assembly is configured to humidify air entering from the air inlet and allow humidified air passing through the wet membrane assembly to be output through the air outlet.

DETAILED DESCRIPTION

Figure 1:
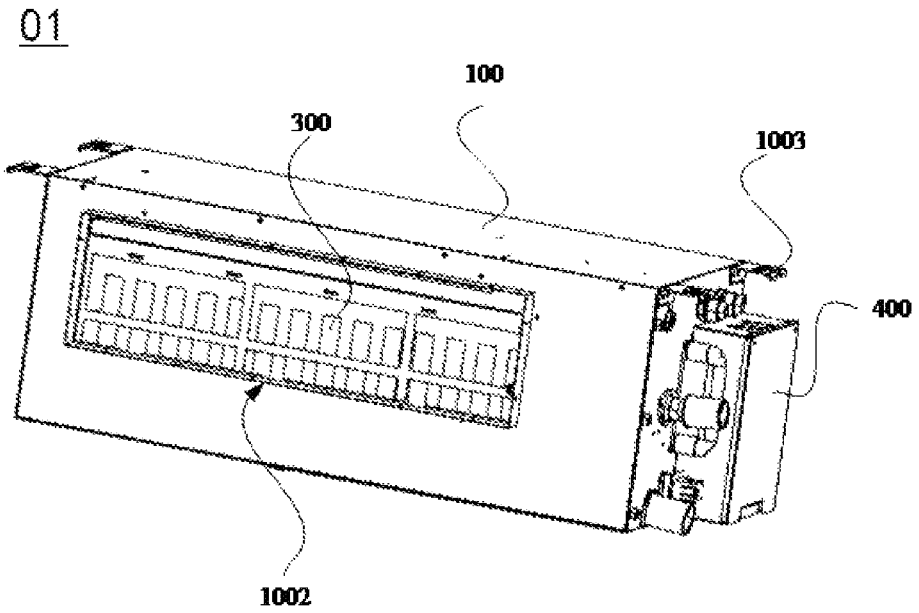
FIG. 1 is a schematic diagram showing a structure of a humidifying device from a perspective, in accordance with some embodiments.

Some embodiments of the present disclosure will be clearly and completely described below with reference to accompanying drawings in the embodiments of the present disclosure. However, the described embodiments are merely some but not all of embodiments of the present disclosure.

Central humidifiers installed by suspension (i.e., suspended from the top of the house) are widely promoted due to their strong humidifying capacity. During use, with prolongation of use time, the humidifier is prone to scaling in the waterway and dirty in the airway due to the influence of water quality. However, limited by the design of hidden in the ceiling (i.e., hidden in the space above the suspended ceiling), it is relatively difficult for operators to operate during later maintenance.

In light of this, some embodiments of the present disclosure provide a humidifying device. As shown in FIGS. 1 to 5, the humidifying device 01 includes a housing 100, a humidifying module 800, and a water spray module 500. The humidifying module 800 includes a water receiving portion 200 and a wet membrane assembly 300 that are assembled together. The water spray module 500 is provided above the humidifying module 800.

The housing 100 is provided therein with an air inlet 1001 and an air outlet 1002 opposite to each other. External air may enter the housing 100 through the air inlet 1001 and is finally output through the air outlet 1002.

In addition, the housing 100 is further provided with third connecting portions 1003 (e.g., suspension connecting portions) at four upper corners of the housing 100, and the housing 100 may be hung on the top of the house by the third connecting portions 1003. For example, the third connecting portion 1003 may be a lifting lug, a hanging hook, or the like.

The humidifying device 01 is suspended from the top of the house by the third connecting portions 1003 provided on the housing 100. The wet membrane assembly 300 is located in the housing 100. The wet membrane assembly 300 may absorb water in the water receiving portion 200 and is used to humidify the air entering from the air inlet 1001 and allow the humidified air passing through the wet membrane assembly 300 to be output through the air outlet 1002. The air enters the housing 100 through the air inlet 1001 and is humidified by the wet membrane assembly 300, and then the humidified air is output to the outside of the housing 100 through the air outlet 1002, thereby adjusting the indoor humidity.

The water receiving portion 200 and the wet membrane assembly 300 are assembled together to form the humidifying module 800. Moreover, the housing 100 includes an installation socket 1004. The wet membrane assembly 300 is disposed in the water receiving portion 200, and the water receiving portion 200 is disposed in the installation socket 1004 in a pluggable manner. Such a design may facilitate disassembly or assembly of the humidifying module 800 as a whole by the operator for maintenance.

After being used for a period of time, the wet membrane assembly 300 provided in the water receiving portion 200 needs to be cleaned or replaced. In this case, the operator only needs to take out the water receiving portion 200 from the installation socket 1004, so that the wet membrane assembly 300 may be taken out from the housing 100 together.

Based on this, the water receiving portion 200 may not only be used as a water supply source to supply the wet membrane assembly 300 with water for humidifying but also be used as a carrier of the wet membrane assembly 300, so that the water receiving portion 200 and the wet membrane assembly 300 may be taken out from the installation socket 1004 of the housing 100 in a unplugging manner. In this way, it is rather convenient for the operator to operate in the top space of the house, thereby improving the operation convenience.

Figure 14:
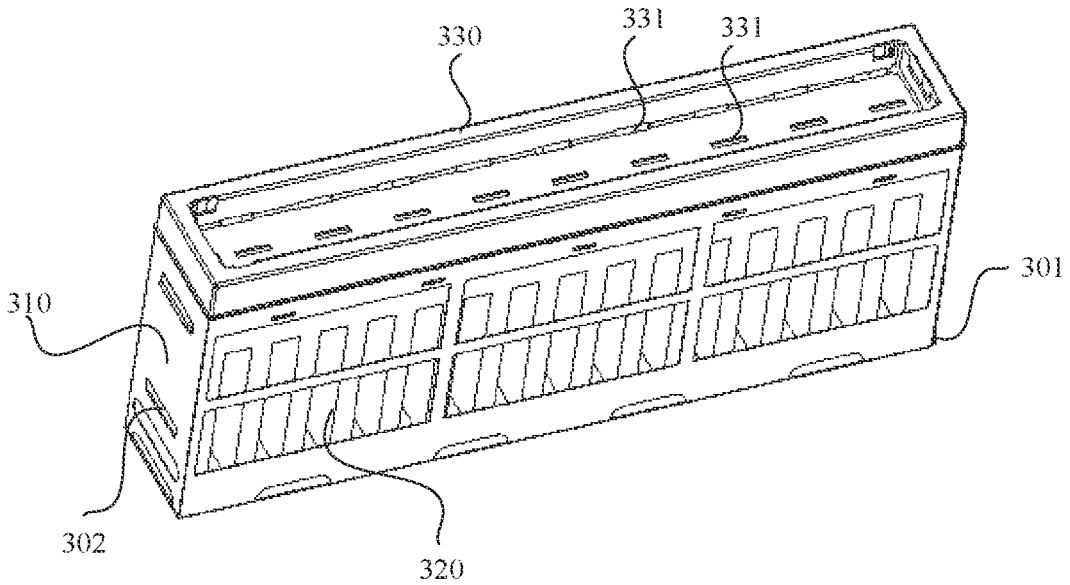
FIG. 14 is a schematic diagram showing a structure of a wet membrane assembly, in accordance with some embodiments.
Figure 15:
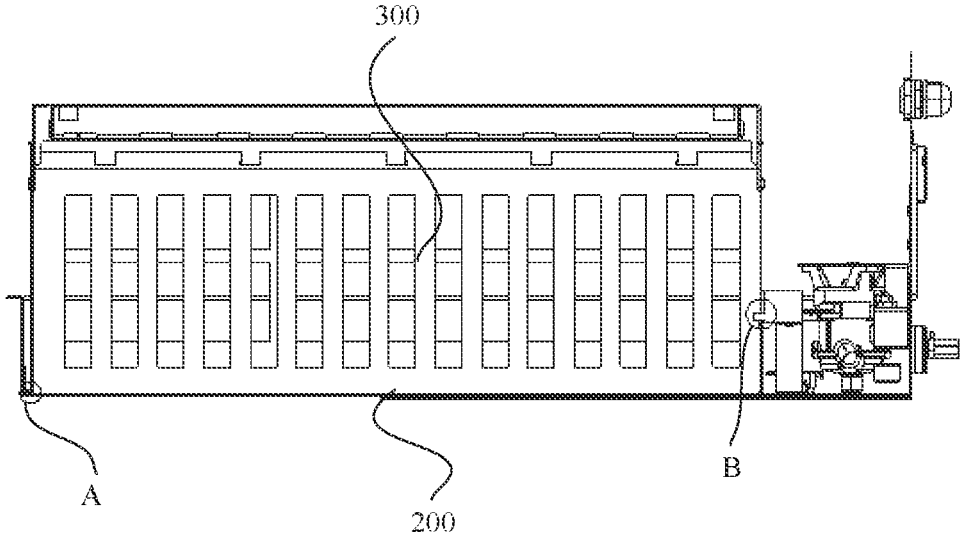
FIG. 15 is an assembly view of a wet membrane assembly and a water receiving portion, in accordance with some embodiments.
Figure 18:
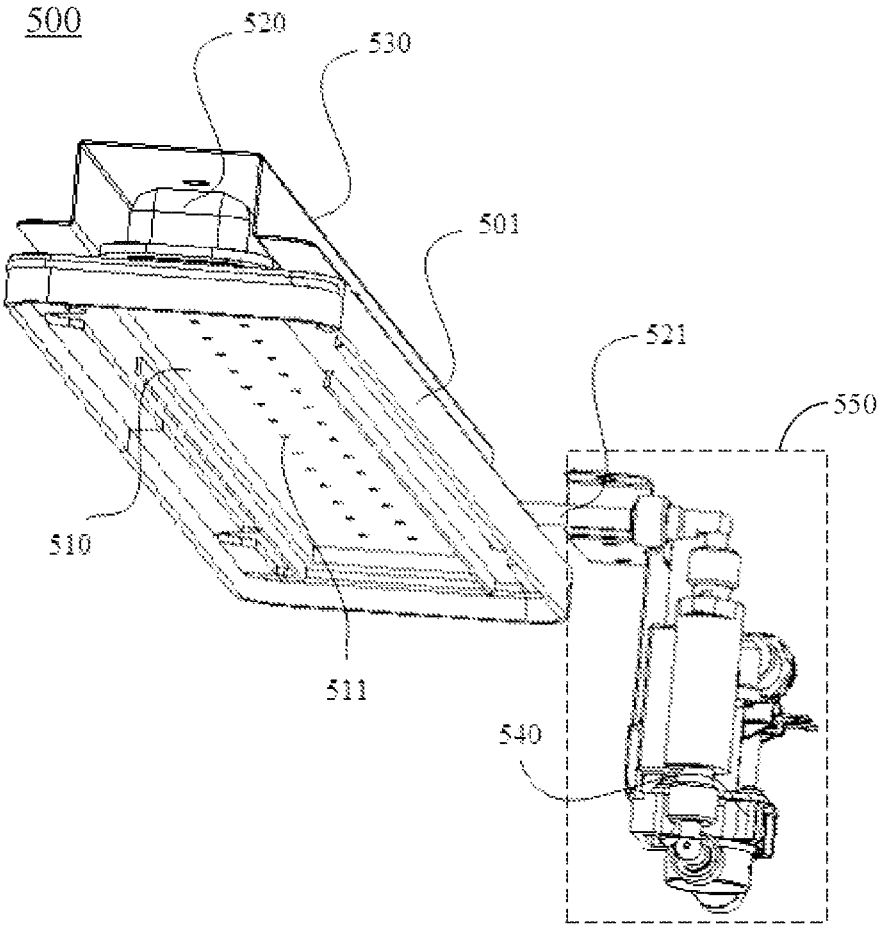
FIG. 18 is a schematic diagram showing a structure of a water spray module, in accordance with some embodiments.

As shown in FIGS. 14 and 18, the wet membrane assembly 300 may include a water receiving tray 330 on the top thereof, and the water receiving tray 330 is provided with a plurality of first through holes 331 (e.g., water transmission holes) therein. The water spray module 500 is disposed on the top of the housing 100 and above the wet membrane assembly 300. The water spray module 500 may include a water spray board 510, a water spray cover 520 disposed on the water spray board 510, and a water inlet assembly 550 communicated with the water spray cover 520. A water storage chamber exits between the water spray board 510 and the water spray cover 520. The water spray board 510 is provided with a plurality of second through holes 511 (e.g., water spray holes) therein for water outlet, and the second through holes 511 are configured to make water in the water storage chamber sprayed on the wet membrane assembly 300 and then flow into the water receiving portion 200 at the bottom.

For example, the water spray cover 520 is disposed on the water spray board 510 in a sealing manner and covers the second through holes 511. The water receiving tray 330 is provided with a plurality of rows of first through holes 331 in the bottom thereof side by side in a width direction of the wet membrane assembly 300. The first through holes 331 may be strip-shaped holes, and the strip-shaped holes extend in a length direction of the wet membrane assembly 300 and are arranged at intervals, which is beneficial to causing water disperse uniformly.

In a case where the indoor humidity needs to be increased, the water spray module 500 may be used to supply water on the top of the wet membrane assembly 300, so as to increase the water content on the surface of the wet membrane assembly 300, thereby improving the ability of humidifying air, which is rather beneficial to improving the humidification performance of the humidifying device.

After the wet membrane assembly 300 has been used for a period of time, there may be a lot of dust and dirt adhered to its surface. The humidifying device may periodically start the water spray module 500 and use the water spray module 500 to perform water spray operation on the top of the wet membrane assembly 300, so as to clean the wet membrane assembly 300. Thus, the frequency of disassembling the humidifying module for maintenance may be reduced, thereby reducing maintenance costs.

Based on this, the water flow velocity of the water spray module 500 may be adjusted by controlling the water flow of the water inlet assembly 550, so that the water spray module 500 may control the water in the water storage chamber to flow onto the wet membrane assembly 300 when the water flow velocity is relatively high, so as to clean the wet membrane assembly 300, and control the water in the water storage chamber to be sprayed onto the wet membrane assembly 300 when the water flow velocity is relatively low, so as to increase the water content of the wet membrane assembly 300.

In a case where water spraying treatment is required, the water in the water storage chamber of the water spray module 500 flows out through the plurality of second through holes 511 in the water spray plate 510 and is collected by the water receiving tray 330 and then is sprayed onto the wet membrane assembly 300 below the water receiving tray 330 through the plurality of first through holes 331 in the water receiving tray 330, so as to realize the water spraying treatment on the wet membrane assembly 300. In this way, it may be possible to avoid splashing of water caused by excessive water volume when the water in the water spray module 500 is directly sprayed on the wet membrane assembly 300. In addition, the second through holes are used to initially disperse the water, so that the water receiving tray 330 may effectively collect the water from the water spray module 500, and then the first through holes are used to further disperse the water, so as to avoid excessive concentration of the water, which is conducive to promoting absorption of the water by the wet membrane assembly 300.

In some embodiments, as shown in FIG. 18, the water inlet assembly 550 may include a water inlet pipe 521 connected to the water spray cover 520 and an electric control valve 540 connected to the water inlet pipe 521. The electric control valve 540 is used to control the water inlet pipe 521 to be turned on or turned off. The water inlet pipe 521 is connected to an external water supply source by the electric control valve and then uses the electric control valve 540 to control the water inlet operation of the water inlet pipe 521.

In a case where the wet membrane assembly 300 needs to be sprayed by the water spray module 500, the water inlet pipe 521 may be controlled to be turned on by the electric control valve 540, so as to introduce water from the external water supply source into the water storage chamber and then make the water sprayed on the wet membrane assembly 300, thereby achieving the water spraying treatment on the wet membrane assembly 300.

In some embodiments, as shown in FIG. 14, the wet membrane assembly 300 may have the structure as follows. The wet membrane assembly 300 includes a box body 310 and a wet membrane 320.

The box body 310 is disposed in the water receiving portion 200 and has an installation cavity. Surfaces of the box body 310 opposite to the air inlet 1001 and the air outlet 1002 are hollow structures, and the top of the box body 310 is an open structure. The wet membrane 320 is located in the installation cavity and is configured to absorb water to humidify the air passing through the wet membrane. The water receiving tray 330 is located on the top of the box body 310.

The box body 310 is used for installing the wet membrane 320, and the box body 310 is provided in the water receiving portion 200, so that the bottom of the wet membrane 320 is submerged in the water in the water receiving portion 200. In this way, the wet membrane 320 may use its own water absorption property to absorb the water in the water receiving portion 200 and make the absorbed water gradually diffuse from the bottom to the whole wet membrane 320. Based on this, the wet membrane 320 is in a wet state as a whole, and then the wet membrane 320 may be used to humidify the air passing through the wet membrane 320.

In some embodiments, as shown in FIGS. 5, 6, 11 and 12, in order to facilitate the operator to install the water receiving portion 200, the installation socket 1004 may be provided at an end of the housing 100, and the water receiving portion 200 may be drawably installed in the installation socket 1004.

In this way, by providing the installation socket 1004 at the end of the housing 100, the water receiving portion 200 may adopt a drawer-type structure, so as to facilitate the drawing of the whole water receiving portion. Since the wet membrane assembly 300 and the water receiving portion 200 are assembled together, the integrated disassembly and assembly may be achieved, so that the wet membrane assembly 300 and the water receiving portion 200 may be pulled out from the installation socket 1004 together. In this way, the space requirement for lateral movement during disassembling the humidifying module may be reduced, thereby saving installation and maintenance space.

Figure 11:
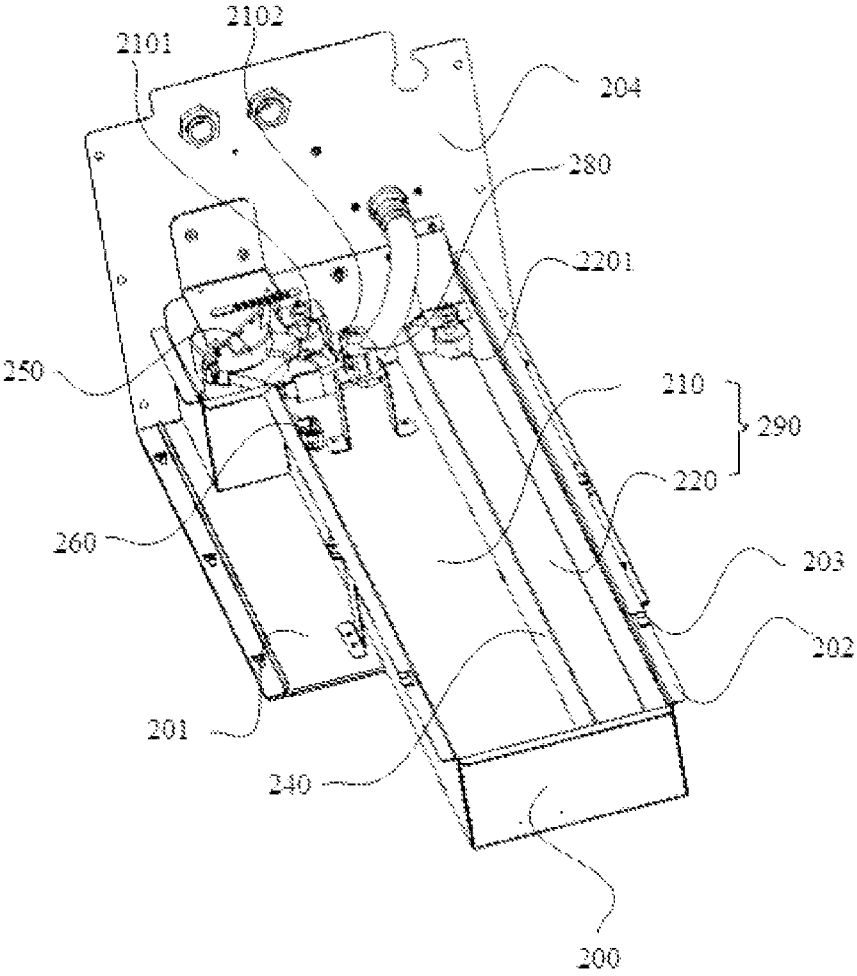
FIG. 11 is a schematic diagram showing a structure of a water receiving portion from a perspective, in accordance with some embodiments.
Figure 12:
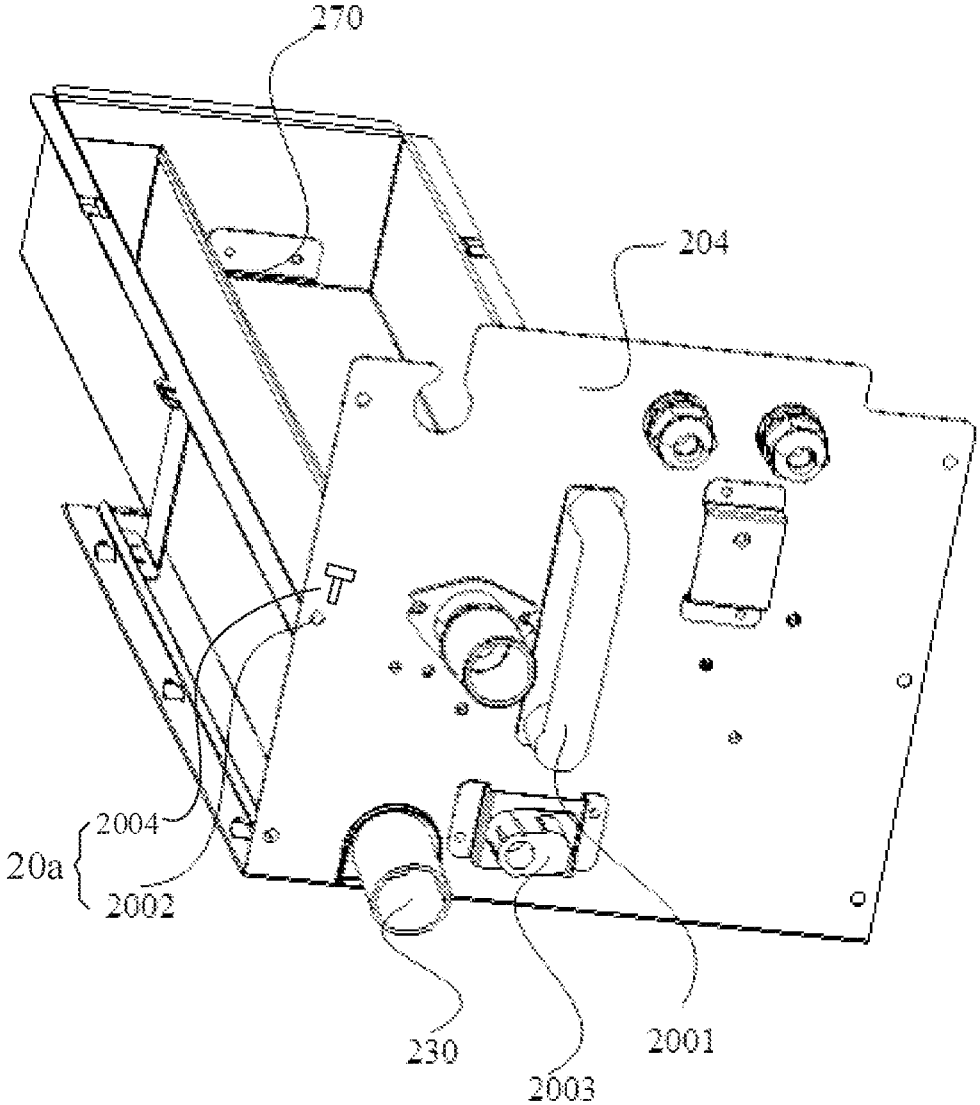
FIG. 12 is a schematic diagram showing a structure of a water receiving portion from another perspective, in accordance with some embodiments.

In some examples, as shown in FIGS. 11 and 12, the water receiving portion 200 includes a water tank 290, a side plate 204 disposed at an end of the water tank 290, and a handle portion 2001 disposed on the side plate 204. The handle portion 2001 may be, for example, a handle. In this way, during assembly or disassembly, it is convenient for the operator to push and pull the water receiving portion 200 through the handle portion 2001.

Figure 7:
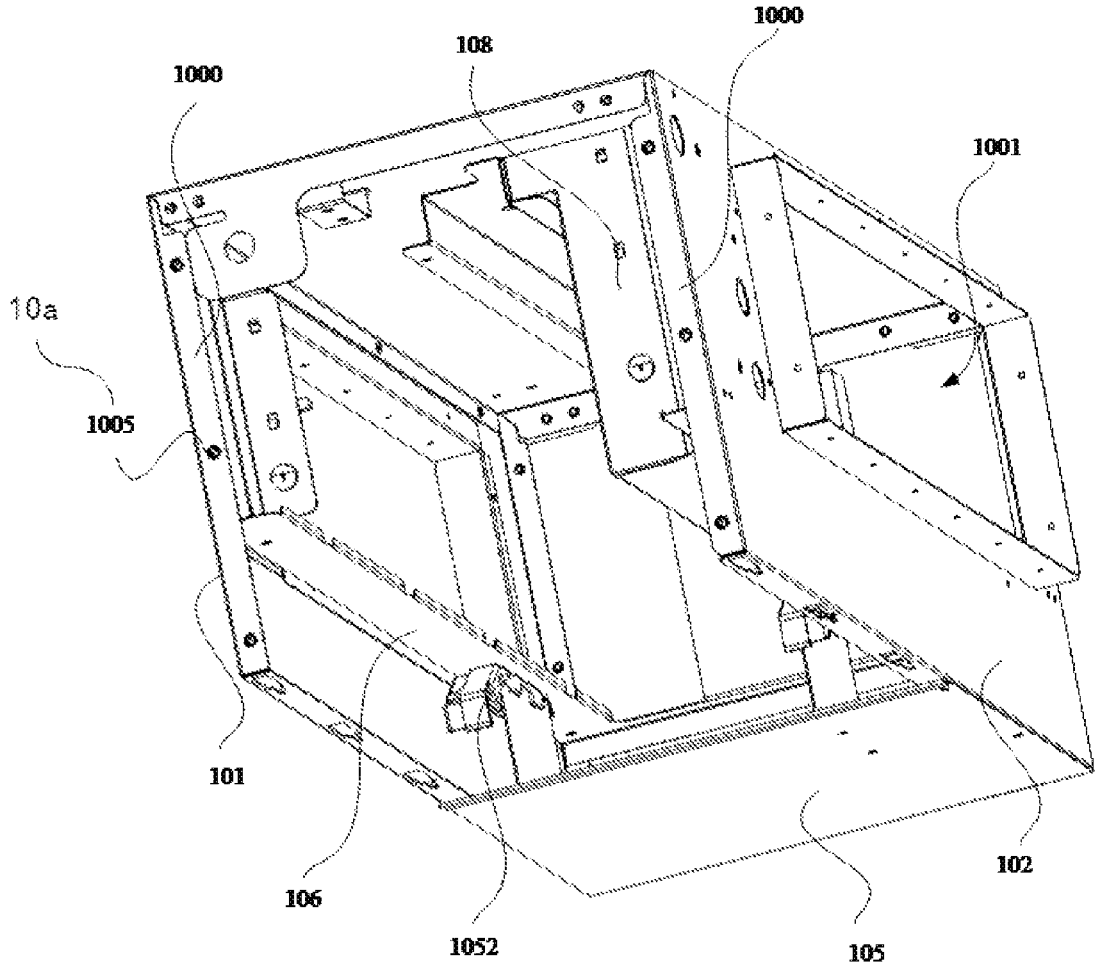
FIG. 7 is a schematic diagram showing a structure of a housing from another perspective, in accordance with some embodiments.

In some embodiments, as shown in FIGS. 7 and 12, in order to facilitate the connection and disassembly between the water receiving portion 200 and the housing 100, the housing 100 is provided with first connecting portions 10*a* on an outside of the installation socket 1004, and the water receiving portion 200 is provided with second connecting portions 20*a* matched with the first connecting portions 10*a*. The second connecting portion 20*a* is detachably connected to the first connecting portion 10*a*.

The first connecting portion and the second connecting portion are connected together in a detachable manner, so that the water receiving portion 200 may be detachably installed on the housing 100. The structures of the first connecting portion and the second connecting portion may vary.

In some examples, the first connecting portion and the second connecting portion are snapped together. For example, the first connecting portion and the second connecting portion may be connected in a conventional snap-fit manner. Alternatively, the first connecting portion and the second connecting portion are screwed together. For example, the housing 100 may be provided with a plurality of threaded holes 1005 (i.e., the first connecting portions 10*a*) therein around the installation socket 1004, the water receiving portion 200 is provided with third through holes 2002 therein, and a bolt 2004 (e.g., a thumb bolt) may pass through a third through hole 2002 and can be threaded into a threaded hole 1005. The bolt 2004 and the third through hole 2002 constitute the second connecting portion 20*a* together.

Figure 2:
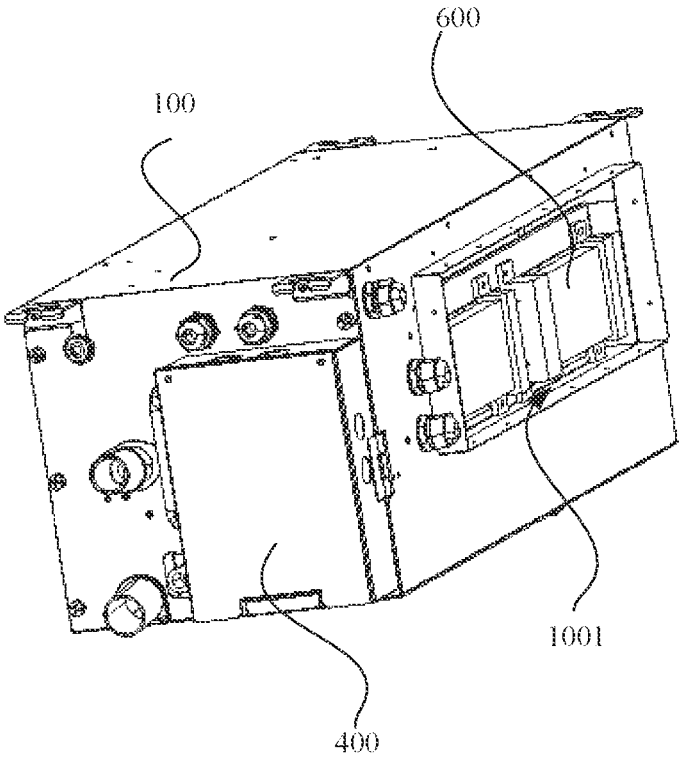
FIG. 2 is a schematic diagram showing a structure of a humidifying device from another perspective, in accordance with some embodiments.
Figure 3:
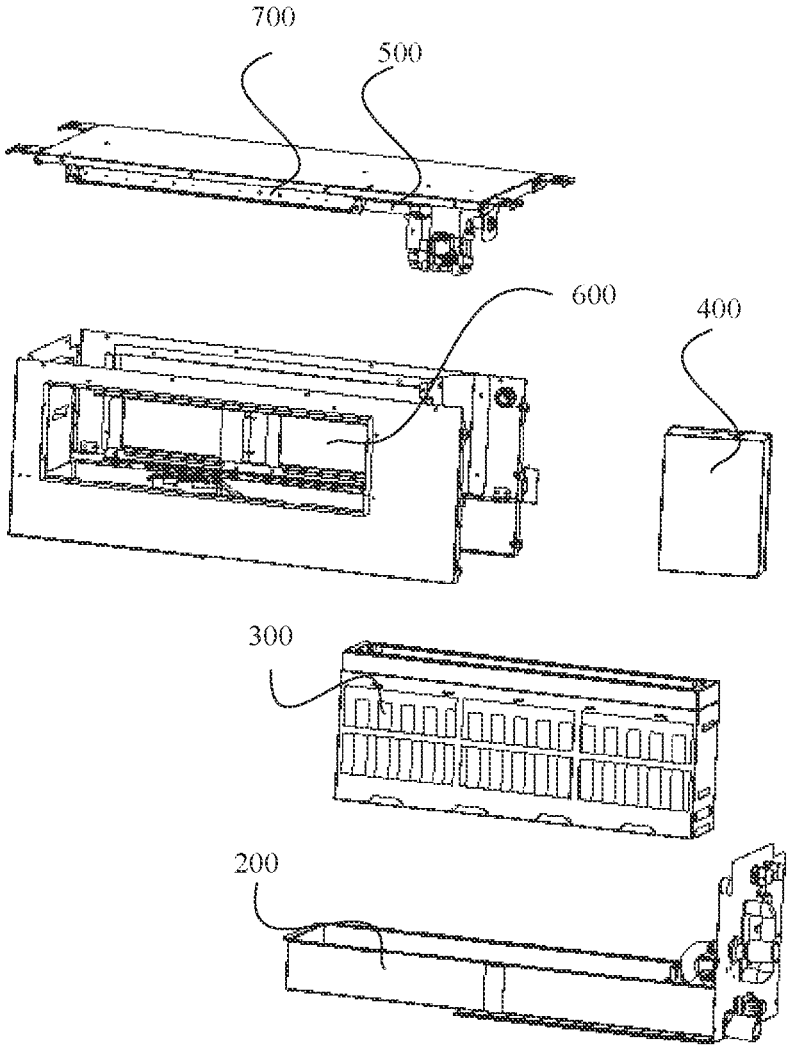
FIG. 3 is an exploded view of a humidifying device, in accordance with some embodiments.

In some embodiments, as shown in FIGS. 1 to 3, the humidifying device further includes an electric control box 400, and the electric control box 400 is provided with an electric control board therein. The electric control board is electrically connected with relevant electrical components in the humidifying device, so as to control operation of the electrical components.

Figure 5:
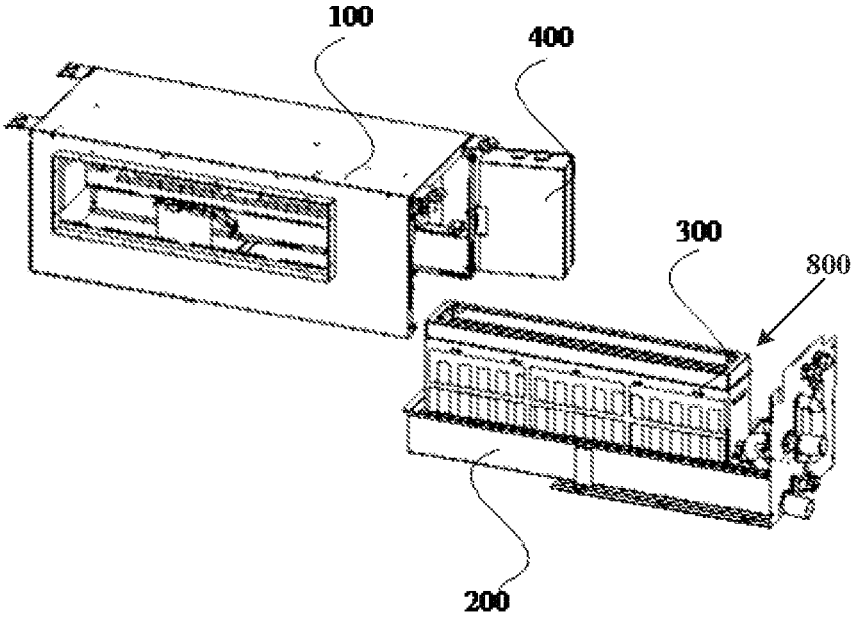
FIG. 5 is a schematic diagram showing a structure of a humidifying device in a disassembled state, in accordance with some embodiments.
Figure 6:
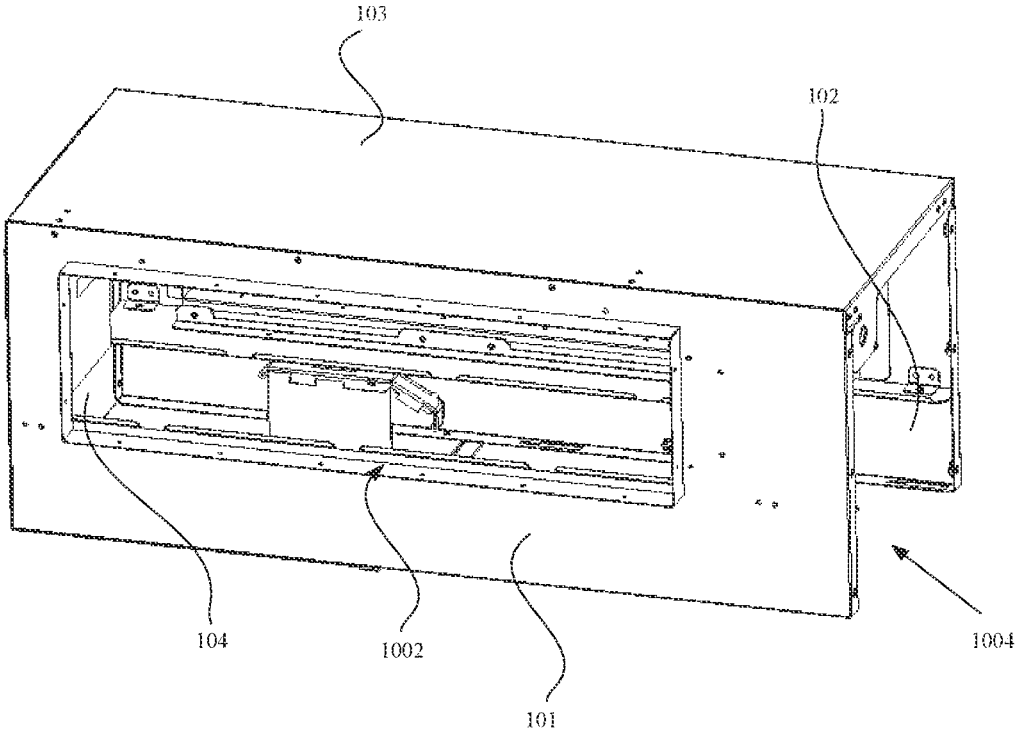
FIG. 6 is a schematic diagram showing a structure of a housing from a perspective, in accordance with some embodiments.

In order to improve reliability of connection and use, the electric control box 400 is rotatably installed at the end of the housing 100. As shown in FIGS. 5 and 12, the water receiving portion 200 further includes a first locking portion 2003 disposed on the side plate 204, and the first locking portion 2003 is used to lock the electric control box 400 on the end of the water receiving portion 200.

During the use of the humidifying device, the electric control box 400 leans against the end of the water receiving portion 200, and the first locking portion 2003 is used to lock the electric control box 400 to the end of the water receiving portion 200. In this way, not only may the position of the electric control box 400 be fixed, but also the electric control box 400 may be used to restrict detachment of the water receiving portion 200 from the installation socket 1004.

In a case where the humidifying module needs to be disassembled, the limit and lock of the first locking portion 2003 on the electric control box 400 is unlocked, and the electric control box 400 is rotated to a side of the water receiving portion 200. Then, the connecting structure between the water receiving portion 200 and the housing 100 is disassembled, so that the water receiving portion 200 and the wet membrane assembly 300 are disassembled together from the housing 100.

In some embodiments, the structure of the first locking portion 2003 may vary, and the following will be described in examples.

For convenience of operation, as shown in FIG. 12, the first locking portion 2003 may be in a form of a knob and achieves locking by turning the knob. For example, the first locking portion 2003 adopts the knob, and an end of the knob is rotatably disposed on the side plate 204 of the water receiving portion 200. Correspondingly, a surface of the electric control box 400 is provided with a recess portion (e.g., a locking hole) matched with the first locking portion 2003, and the knob is used to be rotated and snapped into the recess portion.

It will be noted that the structures of the housing 100, the water receiving portion 200, and the wet membrane assembly 300 may vary, and each component will be illustrated in examples below.

In some embodiments, as shown in FIGS. 6 to 9, the housing 100 includes a front plate 101, a rear plate 102, a top plate 103, and an end plate 104. The front plate 101 is provided with the air outlet 1002 therein, the rear plate 102 is provided with the air inlet 1001 therein, and the top plate 103 is provided with the third connecting portions 1003 thereon.

In order to shorten the unplugging distance of the water receiving portion 200 during disassembly, the housing may further include a support plate 105 disposed at the lower end of the end plate 104. The front plate 101 and the rear plate 102 are arranged oppositely, a side edge of the end plate 104 is connected to a side edge of the front plate 101, and another side edge of the end plate 104 is connected to a side edge of the rear plate 102. The support plate 105 extends in a direction of the length of the housing 100 and is connected to a bottom edge of the front plate 101 and a bottom edge of the rear plate 102, and a dimension of the support plate 105 in the direction of the length of the housing 100 is smaller than the length of the housing 100. The top plate 103 is connected to tops of the front plate 101, the rear plate 102, and the end plate 104, and an end of the housing 100 away from the end plate 104 is the installation socket 1004.

Correspondingly, as shown in FIGS. 5 and 11 to 12, the humidifying module includes the water receiving portion 200 and the wet membrane assembly 300, and the wet membrane assembly 300 is provided in the water receiving portion 200. The water receiving portion 200 further includes a decorative plate 201 on a side of the bottom of the water tank 290.

The humidifying module is inserted into the housing 100 through the installation socket 1004. The support plate 105 supports the bottom of the water receiving portion 200, and the decorative plate 201 and the support plate 105 are spliced together.

The water receiving portion 200 and the wet membrane assembly 300 are inserted into the housing 100 through the installation socket 1004. During insertion of the water receiving portion 200, the decorative plate 201, and the support plate 105 are docked together, so that the water receiving portion 200 is assembled in place.

During disassembly, the operator pulls the handle portion 2001 provided at the end of the water receiving portion 200, so that the water receiving portion 200 together with the wet membrane assembly 300 is pulled out from the housing 100. In a process of pulling out the water receiving portion 200, the water receiving portion 200 may be completely pulled out when it moves to an outer edge of the support plate 105. In this way, the moving distance of the water receiving portion 200 during disassembly and assembly may be effectively shortened, and an overall unplugging distance of the humidifying module may be effectively reduced, thereby reducing the space required for maintenance and thus reducing maintenance difficulty.

Figure 9:
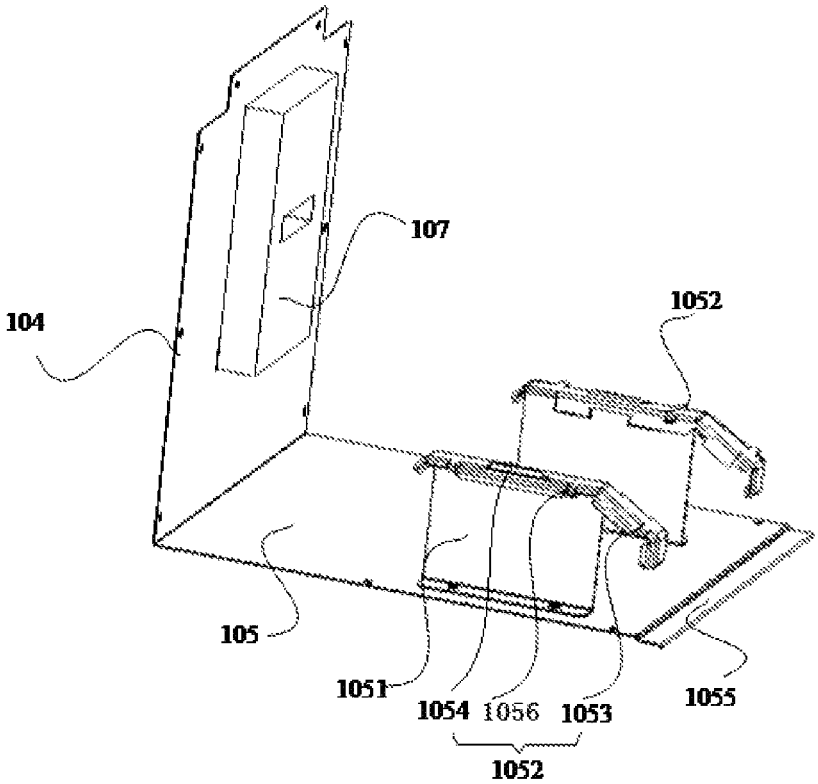
FIG. 9 is a schematic diagram showing a structure of an end plate and a support plate, in accordance with some embodiments.

In some embodiments, as shown in FIGS. 9 and 11, the housing 100 further includes two vertical plates 1051 arranged on the support plate 105 and two sliding rails 1052 respectively arranged on the two vertical plates 1051. The water receiving portion 200 further includes first matching portions 202 (e.g., sliding matching portions) provided on both sides of the water tank 290 and matched with the sliding rails 1052, and the first matching portions 202 are slidably disposed on the corresponding sliding rails 1052. For example, the first matching portions 202 may be flanges.

During disassembly and assembly, the first matching portions 202 provided on both sides of the water tank 290 are used to cooperate with the sliding rails 1052 provided on the support plate 105, so as to support the sliding of the water receiving portion 200 relative to the housing 100, thereby facilitating on-site disassembly or assembly by the operator for maintenance.

In some embodiments, as shown in FIG. 9, the sliding rail 1052 includes a straight portion 1056 and a guide portion 1053 located on a side of the straight portion 1056 away from the end plate 104, and the guide portion 1053 is located at the end of the guide rail 1052 and extends at a tilt downwards (i.e., toward the support plate 105).

During assembly of the water receiving portion 200, the first matching portions 202 on both sides of the water receiving portion 200 may slide upwards through the guide portions 1053 arranged obliquely until sliding onto the straight portions 1056 of the sliding rails 1052. The guidance of the guide portions 1053 is convenient for the operator to quickly and accurately assemble on site.

In order to realize pre-positioning of a sliding position of the water receiving portion 200 when the water receiving portion 200 is slidably assembled, as shown in FIGS. 9 and 11, the water receiving portion 200 further includes limiting portions 203 provided on the first matching portions 202, and the sliding rails 1052 each further include a second matching portion 1054 (e.g., a limiting matching portion) provided on the straight portion 1056 and matched with the limiting portion 203. After the humidifying module is installed on the housing 100, the limiting portions 203 are connected with the second matching portions 1054, so as to realize relative fixing of the water receiving portion 200 and the housing 100.

In a process of the first matching portions 202 of the water receiving portion 200 sliding on the sliding rails 1052, the positioning cooperation of the limiting portion 203 and the second matching portion 1054 may be used to achieve the positioning of the sliding position of the water receiving portion 200. The limiting portion 203 may be a positioning protrusion protruding downward on the first matching portion 202, the second matching portion 1054 is a positioning groove formed in the sliding rail 1052, and the positioning protrusion is located in the positioning groove.

In some embodiments, as shown in FIGS. 9 and 11, in order to support the water receiving portion 200 rather effectively, an end of the water receiving portion 200 is overlapped on the support plate 105. For example, after the water receiving portion 200 is installed in place, an end of the water tank 290 of the water receiving portion 200 may be overlapped on the support plate 105, so that the support plate 105 may support the water receiving portion 200.

Alternatively, an edge of the decorative plate 201 of the water receiving portion 200 is overlapped on a free end of the support plate 105. After the water receiving portion 200 is installed in place, the decorative plate 201 and the support plate 105 are spliced together, and the edge of the support plate 105 is used to support the edge of the decorative plate 201. Therefore, the support plate 105 may be used to support the water receiving portion 200, and it may ensure a flat appearance of the overall bottom face of the housing 100.

For example, the support plate 105 may include a bent edge 1055 disposed at the free end thereof, and the edge of the decorative plate 201 is overlapped on the bent edge 1055. The bent edge 1055 provided at the free end of the support plate 105 may be retracted downward relative to a main body of the support plate 105, so that the bent edge 1055 forms a stepped face. The edge of the decorative plate 201 is overlapped on the stepped face formed by the bent edge 1055.

In some embodiments, as shown in FIGS. 7, 11 and 12, in order to facilitate the firm fixing and installation of the water receiving portion 200, the front plate 101 and the rear plate 102 each include an inner fold edge 1000 located at an end away from the end plate 104. The water receiving portion 200 includes the side plate 204 located at the end of the water tank 290, and the side plate 204 is connected with the inner fold edges 1000.

For example, after the water receiving portion 200 is installed into the housing 100, the side plate 204 is connected with the inner fold edges 1000, so that the water receiving portion 200 may be firmly and reliably fixed on the housing 100.

In order to facilitate disassembly and assembly by the operator, the the inner fold edges 1000 is provided with threaded holes 1005, the side plate 204 is provided with third through holes 2002, and a bolt 2004 passes through a third through hole 2002 and is screwed into a threaded hole 1005. That is, the threaded hole 1005 is the first connecting portion 10*a* provided on the housing 100, and the third through hole 2002 and the bolt 2004 inserted in the third through hole 2002 constitute the second connecting portion 20*a* provided on the water receiving portion 200.

In some embodiments, in order to reduce splashing of water in the water receiving portion 200 due to the influence of the airflow, the housing 100 may further include a baffle plate 106 (e.g., a separator plate). As shown in FIG. 7, the baffle plate 106 is disposed inside the housing 100 (i.e., in the space formed by the front plate 101, the rear plate 102 and the end plate 104), and the baffle plate 106 has a gap 1061 that faces the installation socket 1004.

For example, both the air inlet 1001 and the air outlet 1002 are located above the baffle plate 106, the water receiving portion 200 is located below the baffle plate 106, and the wet membrane assembly 300 passes through the gap 1061 of the baffle plate 106 and is located between the air outlet 1002 and the air inlet 1001.

The external airflow enters the housing 100 through the air inlet 1001 and flows to the wet membrane assembly 300, and the airflow is blocked by the baffle plate 106 below and does not flow to the water receiving portion 200 at the bottom. In this way, it may be possible to effectively reduce or even avoid the splashing of the water caused by the impact of the airflow on the water in the water receiving portion 200, thereby improving reliability of use and user experience.

Figure 10:
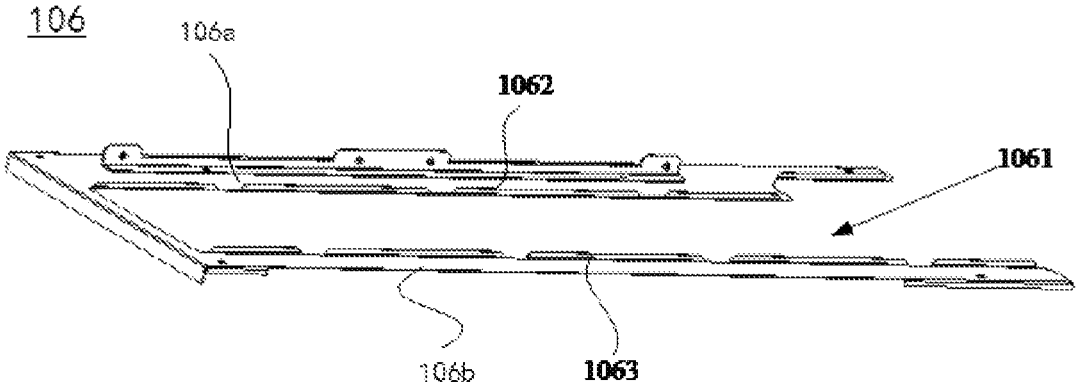
FIG. 10 is a schematic diagram showing a structure of a baffle plate, in accordance with some embodiments.

In some embodiments, as shown in FIG. 10, in order to facilitate the installation of the wet membrane assembly 300, the baffle plate 106 has the gap 1061, and the wet membrane assembly passes through the gap 1061.

For example, an end of the housing 100 is provided with an installation socket 1004, and the water receiving portion 200 is installed pluggably in the installation socket 1004 in a drawer-type structure. After the water receiving portion 200 is inserted in the installation socket 1004, the wet membrane assembly 300 installed in the water receiving portion 200 may enter the housing 100 together through the installation socket 1004, and the wet membrane assembly 300 may pass through the gap 1061 to be exposed between the air inlet 1001 and the air outlet 1002.

The gap 1061 is formed in the baffle plate 106, and an opening of the gap faces the installation socket 1004. For example, the gap 1061 is formed at an end of the baffle plate 106 proximate to the installation socket 1004. During assembly, the water receiving portion 200 and the wet membrane assembly 300 are inserted into the installation socket 1004, and the wet membrane assembly 300 is inserted into the gap 1061, so that the operator may slide the water receiving portion 200 and the wet membrane assembly 300 sideways into the housing 100.

In addition, as shown in FIG. 7, in order to facilitate sliding installation of the water receiving portion 200, the sliding rails 1052 are provided in the housing 100. Moreover, the first matching portions 202 are provided on both sides of the water tank 290 of the water receiving portion 200, so that the water receiving portion 200 is slidably installed on the sliding rails 1052 through the first matching portions 202. Correspondingly, an overlapping area formed by the first matching portions 202 and the baffle plate 106 in the vertical direction may rather effectively block the airflow from entering the water receiving portion 200, so as to avoid the splashing of the water.

In some embodiments, as shown in FIG. 10, the baffle plate 106 includes a first portion 106*a* proximate to the air inlet, a second portion 106*b* proximate to the air outlet, and a connecting portion between the first portion 106*a* and the second portion 106*b*. The baffle plate 106 further includes a first rib plate 1062 connected to the first portion 106*a* and extending upward. The first rib plate 1062 is located at an edge of the first portion 106*a* proximate to the gap 1061. The first rib plate 1062 extends upwards to block downward flow of the airflow, which is rather beneficial to prevent the splashing of the water.

Moreover, the baffle plate 106 further includes a second rib plate 1063 connected to the second portion 106*b* and extending upward. The second rib plate 1063 is located at an edge of the second portion 106*b* proximate to the gap 1061. The second rib plate 1063 extends upwards to block the water in the water receiving portion 200 at the air outlet. A distance between a windward surface of the wet membrane assembly proximate to the air inlet and the first rib plate 1062 is smaller than a distance between a leeward surface of the wet membrane assembly proximate to the air outlet and the second rib plate 1063.

In addition, the first rib plate 1062 and the second rib plate 1063 each include a plurality of ribs, and two adjacent ribs have a space therebetween. The first rib plate 1062 and the second rib plate 1063 both adopt segmented designs. After water drops onto the baffle plate 106, the water may flow into the water receiving portion 200 below through the space between the two adjacent ribs.

In some embodiments, in order to improve the humidification efficiency and improve user experience, the housing 100 is further provided with a windshield portion therein. The water receiving portion 200 is located at the bottom of the housing 100, the wet membrane assembly 300 is vertically disposed in the housing 100, and the windshield portion is provided on a periphery of the wet membrane assembly 300 and is used to block the airflow input from the air inlet 1001 from being output from the periphery of the wet membrane assembly 300 to the air outlet 1002.

During use, since the wet membrane assembly 300 is inserted in the water receiving portion 200, the airflow cannot bypass the bottom of the wet membrane assembly 300. The two sides and the top of the wet membrane assembly 300 are blocked by the windshield portion, so that the airflow entering the housing 100 may pass through the wet membrane assembly 300 for humidification to the greatest extent, thereby effectively improving the humidification efficiency.

In addition, in a process where the airflow entering the housing 100 from the air inlet 1001 is humidified by the wet membrane assembly 300 and output through the air outlet 1002, a high-pressure area exists between the air inlet 1001 and the wet membrane assembly 300, and a low-pressure area exists between the air outlet 1002 and the wet membrane assembly 300.

The high pressure area on a windward side of the wet membrane assembly 300 will be a relatively dry area, while the low pressure area on a leeward side of the wet membrane assembly 300 will be a relatively wet area. In this way, when the humidifying device is subjected to anti-corrosion treatment, emphasis may be placed on an area of the wet membrane assembly 300 forming the low-pressure area, which is more conducive to reducing manufacturing costs.

The windshield portion is arranged on the top and both sides of the wet membrane assembly, so as to effectively block a portion of the wet membrane assembly 300 from being exposed outside the water receiving portion 200.

As shown in FIG. 18, the windshield portion includes a shielding portion 501 (e.g., a shielding ring) provided on the top of the housing 100. The shielding portion 501 is arranged around a periphery of the top of the wet membrane assembly. In some examples, the shielding portion 501 may be included in the water spray module 500 and is arranged around the water spray board 510.

The shielding portion 501 arranged on the top of the wet membrane assembly 300 may shield a top area of the wet membrane assembly 300, so as to reduce the output of the airflow bypassing the top of the wet membrane assembly 300.

In addition, the housing 100 is provided with the installation socket 1004 at a first end thereof, and the water receiving portion 200 is designed as a drawer-type structure to be inserted into the installation socket 1004. Correspondingly, as shown in FIG. 9, the windshield portion further includes a sealing gasket 107. The sealing gasket 107 is vertically arranged on a second end (i.e., the end plate 104) of the housing 100, and the wet membrane assembly abuts against the sealing gasket 107. The first end and the second end of the housing 100 are oppositely arranged.

After the water receiving portion 200 is inserted into the installation socket 1004, the wet membrane assembly 300 will abut against the sealing gasket 107. The sealing gasket 107 is arranged vertically, and thus the sealing gasket 107 may seal an end face of the wet membrane assembly 300 proximate to the second end of the housing 100, thereby reducing the output of the airflow bypassing the end of the wet membrane assembly 300.

Figure 8:
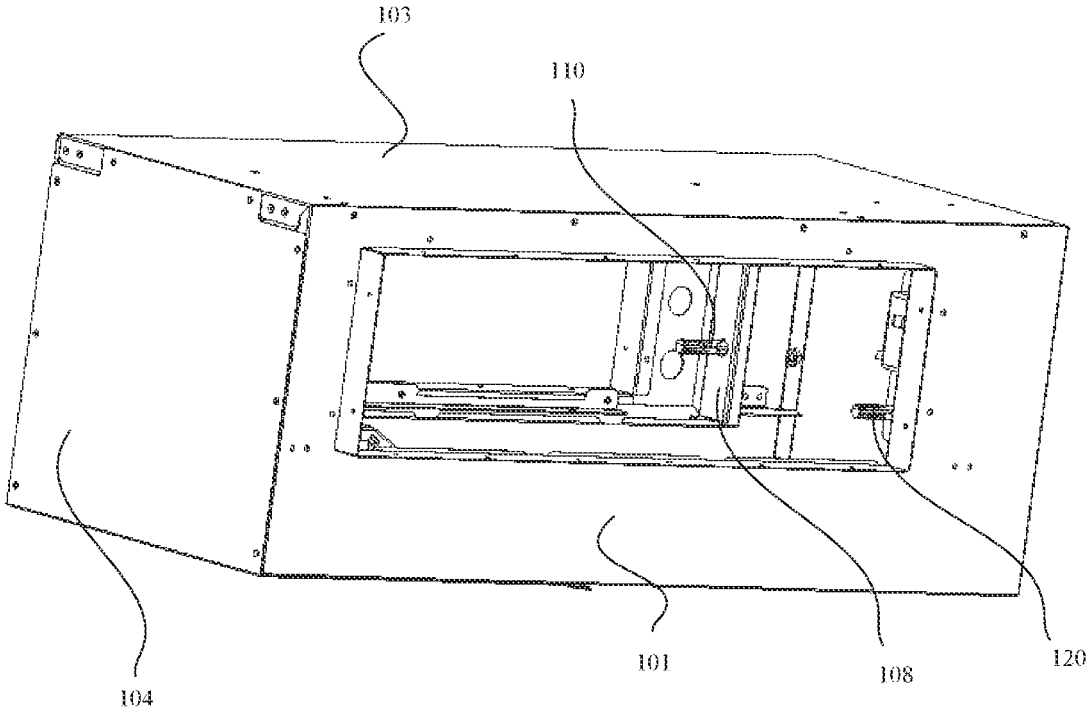
FIG. 8 is a schematic diagram showing a structure of a housing from yet another perspective, in accordance with some embodiments.

In order to reduce the airflow bypassing another end face of the wet membrane assembly 300 proximate to the first end of the housing 100, as shown in FIGS. 7 and 8, the windshield portion further includes an air deflector 108. The air deflector 108 is arranged vertically in the housing 100 and proximate to the first end of the housing 100, an end of the air deflector 108 is disposed on the housing 100 and located on an outer side of the air inlet 1001 away from the end plate 104, and another end of the air deflector 108 extends towards the wet membrane assembly 300.

For example, after the airflow enters the housing 100 through the air inlet 1001, the airflow will be guided to the wet membrane assembly 300 through the air deflector 108, thereby reducing the airflow bypassing the wet membrane assembly 300 and output from the end of the housing. Along the flow direction of the airflow, an overlapping area is formed between the end of the wet membrane assembly 300 proximate to the installation socket 1004 and the air deflector 108, the overlapping area may effectively reduce the overflow of the airflow, and the air deflector 108 is used to guide the airflow towards the middle of the wet membrane assembly 300 to the greatest extent.

In some embodiments, the housing 100 is provided with the baffle plate 106 therein to block the water receiving portion 200, and the first matching portions 202 arranged on both sides of the water receiving portion 200 may not only cooperate with the sliding rails 1052 in the housing 100 to achieve sliding, but also form the overlapping area with the baffle plate 106 in the vertical direction, so as to prevent airflow from bypassing the bottom of the water receiving portion 200 to release air.

By providing the windshield portion in the housing 100, the windshield portion is provided on the periphery of the wet membrane assembly, and may be used to prevent the airflow entering the housing 100 from being output from the periphery of the wet membrane assembly, so as to ensure that the airflow output from the air outlet 1002 may be effectively humidified by the wet membrane assembly, thereby improving humidification efficiency and user experience. In addition, under the shielding effect of the windshield portion, the windward surface and the leeward surface of the wet membrane assembly are respectively two parts of the high-pressure area and the low-pressure area. The high-pressure area and the low-pressure area realize dry/wet separation area setting correspondingly, which may greatly facilitate adoption of different anti-corrosion, moisture-proof, and waterproof measures and requirements for components in different areas, thereby effectively reducing design complexity and costs of material selection and model selection.

In some embodiments, the water receiving portion 200 is used for holding water, and is also used for fixing the wet membrane assembly 300. During supplying water for the water receiving portion 200, in order to reduce overflow of the water in the water receiving portion 200 into the housing 100, the following structural improvements are made to the water receiving portion 200.

As shown in FIGS. 11 and 12, the water receiving portion 200 includes a main water tank 210 (e.g., a main tank body) and an auxiliary water tank 220 (e.g., an auxiliary tank body) that are mutually independent. The water receiving portion 200 is provided with a water inlet for supplying water to the main water tank 210, and the water receiving portion 200 is further provided with a water outlet 230 for discharging water stored in the auxiliary water tank 220. The main water tank 210 and the auxiliary water tank 220 have an overflow area therebetween, and the height of the overflow area is lower than the height of the side wall of the water tank 290.

For example, two independent main water tank 210 and auxiliary water tank 220 are formed in the water receiving portion 200, and the wet membrane assembly 300 is installed in the main water tank 210. During use, in a case where water is continuously injected from the water inlet into the main water tank 210 due to failure and the like, the water level in the main water tank 210 rises gradually and exceeds the upper edge of the overflow area.

The water in the main water tank 210 will overflow into the auxiliary water tank 220, and the water entering the auxiliary water tank 220 will be directly discharged to the outside of the housing 100 through the water outlet 230. The water outlet 230 is connected with a drain pipe during installation, and the drain pipe runs obliquely downwards, so that the water flow is directed to a set area for discharge.

In this way, it may effectively prevent water from overflowing into the housing 100 due to the excessively high water level in the main water tank 210, and thus the overall reliability of use of the humidifying device may be effectively improved, and the user experience may be optimized.

In some embodiments, for the overflow area formed between the main water tank 210 and the auxiliary water tank 220, a partition 240 may be provided in the water tank 290, and the partition 240 separates the water tank 290 into the main water tank 210 and the auxiliary water tank 220.

For example, in a case where the water level of the main water tank 210 is excessively high, the water in the main water tank 210 may overflow the partition 240 and overflow into the auxiliary water tank 220. The height of the upper edge of the partition 240 is lower than the height of the side wall of the water tank 290, and the upper edge of the partition 240 forms the overflow area. Alternatively, an overflow opening is provided in the partition 240, and the overflow opening forms the overflow area.

In some embodiments, as shown in FIG. 11, in order to accurately detect the water level of the main water tank 210 to control the water injection amount of the main water tank 210, the main water tank 210 is provided therein with a first water level detector 2101 and a second water level detector 2102, and a water level detection height of the first water level detector 2101 is higher than a water level detection height of the second water level detector 2102.

In a process of filling water into the main water tank 210, the second water level detector 2102 is used to detect the lowest water level in the main water tank 210 to trigger the external water supply source to supply water, and the first water level detector 2101 is used to detect the highest water level in the main water tank 210 to trigger the external water supply source to cut off the water.

In addition, in order to improve the reliability of use, the auxiliary water tank 220 is provided with a third water level detector 2201 therein.

In a case where the external water supply source fills the main water tank 210 with water continuously due to the failure of the first water level detector 2101, the water in the main water tank 210 overflows into the auxiliary water tank 220. The third water level detector 2201 is provided in the auxiliary water tank 220 and is used to detect the water level height in the auxiliary water tank 220. In this way, in a case where the water outlet 230 in the auxiliary water tank 220 is blocked due to dirt, the external water supply source may be triggered to cut off the water when the third water level detector 2201 detects that the water level in the auxiliary water tank 220 is higher than the set water level.

The first water level detector 2101, the second water level detector 2102 and the third water level detector 2201 may adopt liquid level detection devices such as water level sensors and water floats in the conventional technology, and there is no limitation here.

In some embodiments, as shown in FIG. 11, the water receiving portion 200 further includes a drain pump 250 located in the main water tank 210, and the drain pump 250 is used to drain the water in the main water tank 210.

For example, in a case of not using the humidifying device fora long time, in order to avoid spoilage of the water in the water receiving portion 200, the water in the main water tank 210 may be drained by the drain pump 250, so as to reduce spoilage of the water due to the excessive water in the main water tank 210.

On this basis, the electric control board in the electric control box 400 may be electrically connected with the drain pump 250, so as to control the operation of the drain pump 250.

Moreover, in order to improve the antibacterial ability of the water receiving portion 200 during use, the water receiving portion 200 may further include an antibacterial portion 260 disposed in the main water tank 210. For example, the antibacterial portion 260 may be a slow-release box filled with the antibacterial material.

During use, the antibacterial material in the antibacterial portion 260 may play a slow-release and antibacterial role with the water in the main water tank 210, and may further diffuse to the wet membrane assembly 300 together with the water in the water receiving portion 200, thereby improving water quality during humidification.

In addition, the antibacterial material may adopt silver ions and other antibacterial materials, which is not limited here. Taking the silver ion antibacterial agent filled in the antibacterial portion 260 as an example, the silver ion antibacterial agent in the water receiving portion 200 may be continuously released to ensure a sufficient concentration of silver ions in the waterway all times, so as to continuously prevent the growth of microorganisms on the water-containing components.

In some embodiments, for the humidifying module composed of the water receiving portion 200 and the wet membrane assembly 300, for the convenience of quick disassembly and assembly of the two to simplify the maintenance process, the structures of the water receiving portion 200 and the wet membrane assembly 300 are described as follows.

For the water receiving portion 200, the inside of the water tank 290 is used for water storage. Moreover, as shown in FIGS. 11 to 17, an end of the water tank 290 is fixedly provided with a plug-in portion 270 thereon, and an end of the wet membrane assembly 300 is provided with a third matching portion 301 (e.g., a plug-in matching portion) matching with the plug-in portion 270. The water receiving portion 200 is further provided with a rotatable second locking portion 280 therein, and another end of the wet membrane assembly 300 is provided with a recess portion 302 (e.g., a locking hole) therein.

Figure 16:
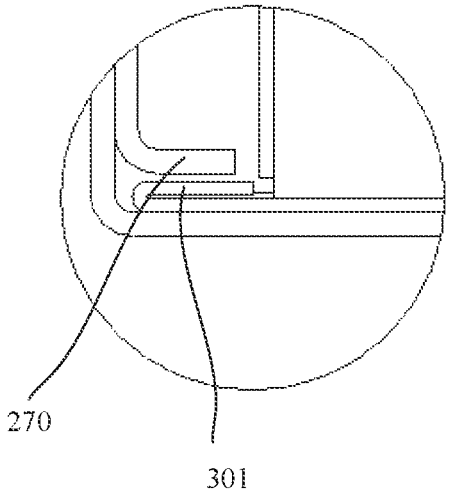
FIG. 16 is an enlarged schematic diagram of an area A in FIG. 15.
Figure 17:
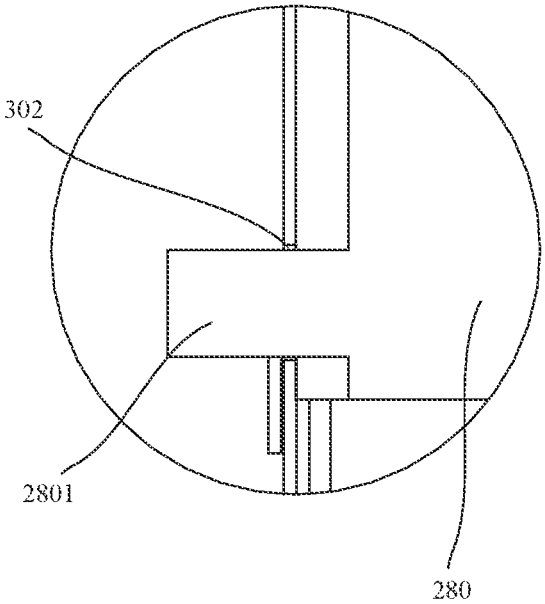
FIG. 17 is an enlarged schematic diagram of an area B in FIG. 15.

The wet membrane assembly 300 is arranged in the water receiving portion 200, the plug-in portion 270 and the third matching portion 301 are plugged together, and the second locking portion 280 is used to be rotated and snapped into the recess portion 302. For example, as shown in FIG. 16, the plug-in portion 270 is a bent structure welded on the end inside the water tank 290, the bent structure and a bottom face of the water tank 290 have a gap therebetween, the third matching portion 301 is a flange, and the flange is inserted into the gap, so as to fix a side of the wet membrane assembly 300.

For example, during assembly of the humidifying module, the third matching portion 301 of the wet membrane assembly 300 is first inserted into the plug-in portion 270 provided on the end inside the water receiving portion 200 to achieve pre-positioning, and the wet membrane assembly 300 is put into the water receiving portion 200, then the second locking portion 280 is rotated to be snapped into the recess portion 302, so that the wet membrane assembly 300 is firmly and reliably installed in the water receiving portion 200.

During disassembling the humidifying module, the second locking portion 280 is first rotated to disengage from the recess portion 302, and then the operator pulls up the wet membrane assembly 300, so as to disassemble the wet membrane assembly 300 from the water receiving portion 200. The entire disassembly or assembly process does not require tools, thereby facilitating on-site maintenance operations by the operator.

The connection structure between the plug-in portion 270 and the third matching portion 301 may vary.

For example, the plug-in portion 270 is a first slot provided in the water receiving portion 200, the third matching portion 301 is a first tongue provided on the wet membrane assembly 300, and the first tongue is inserted into the first slot.

During actual operation, the wet membrane assembly 300 is obliquely put into the water receiving portion 200, and the first tongue is inserted into the first slot, so that the wet membrane assembly 300 is pre-installed into the water receiving portion 200.

Alternatively, the plug-in portion 270 is a second tongue provided in the water receiving portion 200, the third matching portion 301 is a second slot provided on the wet membrane assembly, and the second tongue is inserted into the second slot.

In some embodiments, the structure of the second locking portion 280 may vary, and the following will be described in examples.

For convenience of operation, the second locking portion 280 may be in a form of a knob and achieves locking by turning the knob. For example, a support frame is provided in the water receiving portion 200, the second locking portion 280 adopts a knob, an end of which is rotatably disposed on the support frame, and the knob is used to be rotated and snapped into the recess portion 302.

In order to improve convenience of operation, as shown in FIGS. 13 to 17, the knob is provided with a protrusion portion 2801 (e.g., a tab) extending outward, and the protrusion portion 2801 is inserted into the recess portion 302. By turning the knob, the protrusion portion 2801 is rotated and inserted into the recess portion 302, so that the wet membrane assembly 300 is locked and fixed by the knob.

Figure 13:
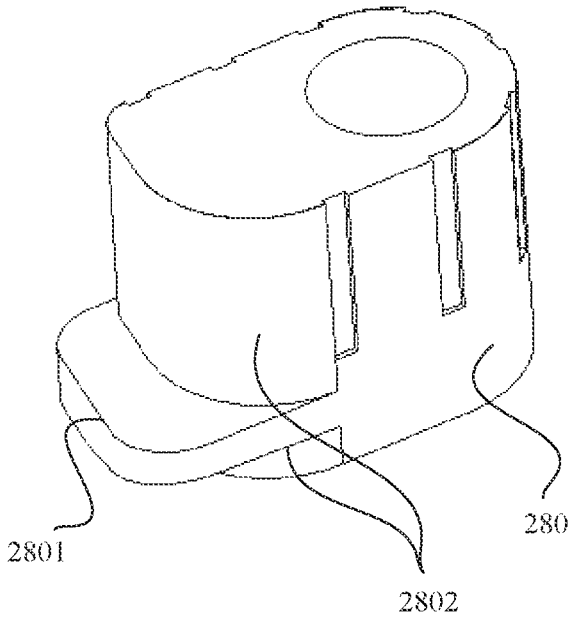
FIG. 13 is a schematic diagram showing a structure of a locking portion, in accordance with some embodiments.

In some embodiments, as shown in FIG. 13, the side of the knob is further provided with a guide surface 2802 such as an arc guide surface, and the guide surface 2802 abuts against the wet membrane assembly 300. During assembly, when the knob is turned, the guide surface 2802 guides the knob to rotate outside the wet membrane assembly 300, so that the knob closely abuts against the end of the wet membrane assembly 300 finally. The guide surface 2802 is distributed on a side of the knob.

Moreover, the protrusion portion 2801 extends outward perpendicular to the guide surface 2802. The knob includes portions of the guide surface 2802 respectively located above and below the protrusion portion 2801, and the portions of the guide surface 2802 arranged above and below the protrusion portion 2801 may be closely attached to the wet membrane assembly 300, so as to ensure stability and reliability of the locking of the wet membrane assembly.

The first locking portion 2003 may also be in the form of the knob, and the structure thereof may refer to the above description about the second locking portion 280.

In some embodiments, as shown in FIG. 18, the water spray module 500 may further include a first bracket 530 (e.g., a hanging bracket). The first bracket 530 is configured to suspend the water spray module 500 on the top of the housing 100, and the water spray board 510 is disposed on the first bracket 530.

The water spray module 500 is installed and fixed on the top of the housing 100 by the first bracket 530, the water spray board 510 is fixed on the bottom of the first bracket 530, and the water spray cover 520 is located between the water spray board 510 and the first bracket 530.

In addition, the water spray module 500 may further include a shielding portion 501 (i.e., the above shielding portion used as a portion of the windshield portion), and the shielding portion 501 surrounds the periphery of the water spray board 510.

As a part of the water spray module 500, the shielding portion 501 may not only block the top of the wet membrane assembly 300, so as to prevent the airflow from bypassing the top of the wet membrane assembly 300, but also block the water sprayed by the water spray board 510, so as to avoid water leaking caused by spraying water everywhere during the water spraying.

The shielding portion 501 also surrounds the periphery of the top of the wet membrane assembly 300, so as to rather effectively block the airflow from bypassing the top of the wet membrane assembly 300. In addition, during the water spraying, the water output through the water spray board 510 may be directly sprayed on the top of wet membrane assembly 300.

In order to effectively reduce the mould inside the humidifying device to improve the air quality and the user experience during use, the following improvement is made to the humidifying device.

In some embodiments, as shown in FIGS. 1 to 4, the humidifying device 01 may further include a drying module 600. The drying module 600 is used for heating the air entering the housing 100. The humidifying module 800 is provided in the housing 100, and the drying module 600 is provided on the housing 100 and proximate to the air inlet 1001.

The structure of the drying module 600 may vary. For example, the drying module 600 is a conventional electric heating component, such as an electric heating tube, an electric heating wire, or an electric heating plate, arranged proximate to the air inlet 1001.

During humidification, the water receiving portion 200 is filled with water. The humidifying module uses the water to humidify the air passing through the humidifying module. The accumulated water in the humidifying module may cause deterioration of water quality and further lead to mould formation of components. By adding the drying module 600, after the humidification is completed, the water in the water receiving portion 200 may be drained first, and then the drying module 600 may be started to generate hot air, so that the air entering the housing 100 may be heated by the hot air, thereby drying the humidifying module. Thus, most components including the wet membrane assembly in the humidifying device may be in dry states. In this way, it may effectively inhibit the growth of microorganisms inside, improve the anti-mould effect of the humidifying device, and further improve the air quality and the user experience.

In order to accurately control the humidity of the air outlet, as shown in FIG. 8, the humidifying device may further include a first humidity sensor 110 (e.g., an inlet humidity sensor) and a second humidity sensor 120 (e.g., an outlet humidity sensor) that are arranged in the housing 100. The first humidity sensor 110 is provided at the air inlet 1001 and is used to detect humidity of air at the air inlet 1001, and the second humidity sensor 120 is provided at the air outlet 1002 and is used to detect humidity of air at the air outlet 1002.

During operation of the humidifying device, the first humidity sensor 110 and the second humidity sensor 120 are respectively used to detect the humidity of the inlet air and the humidity of the outlet air, so as to control the wind speed.

During drying and anti-mould operation, the drying module 600 is controlled to start or stop according to the humidity values of the first humidity sensor 110 and the second humidity sensor 120.

The humidity value detected by the second humidity sensor 120 is PW1, and the humidity value detected by the first humidity sensor 110 is PW2. In a process of the drying module 600 being powered on for heating and drying, in a case where a difference between PW2 and PW1 is less than or equal to A (i.e., PW2−PW1≤A), the drying module 600 is turned off. According to needs, the value of A may be less than or equal to 4%, such as 4%, 3.5%, 3%, or 2%.

Figure 4:
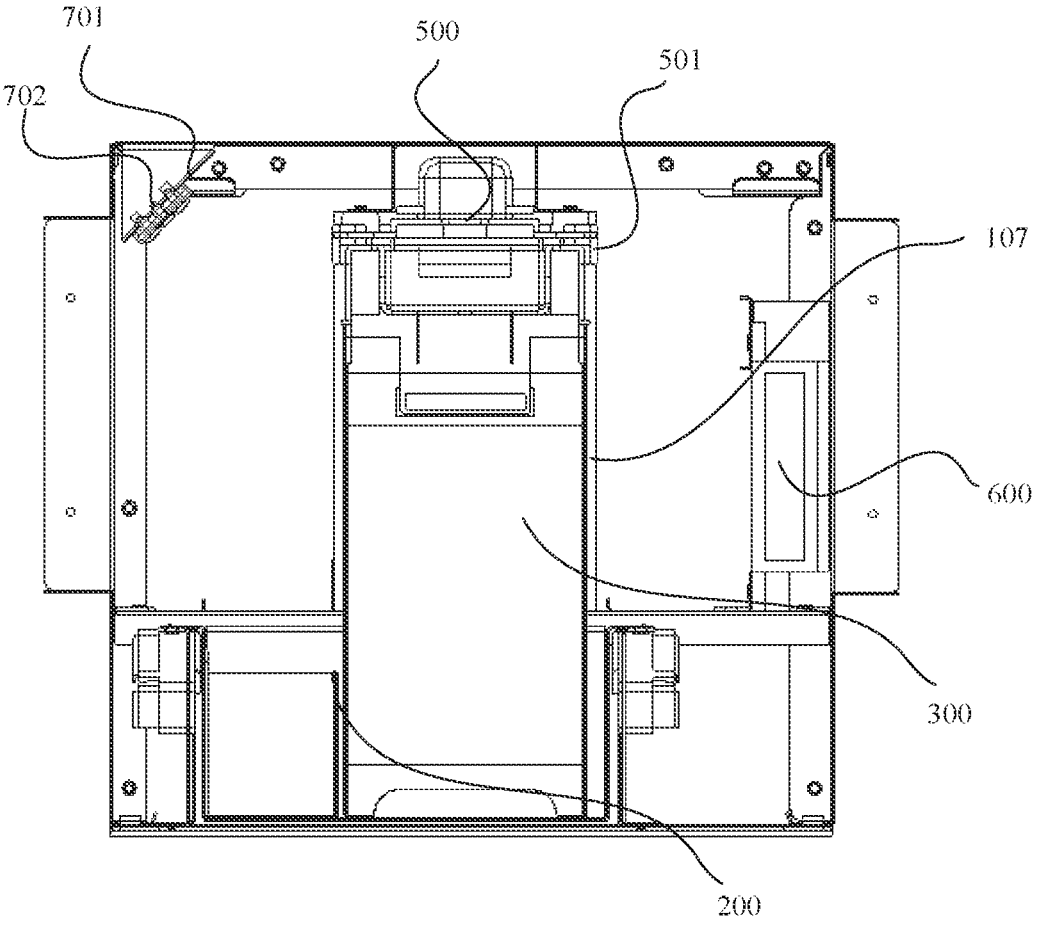
FIG. 4 is a sectional view of a humidifying device, in accordance with some embodiments.

In some embodiments, in order to effectively sterilize the air at the air outlet 1002 of the housing 100, as shown in FIGS. 3 and 4, the humidifying device further includes an ultraviolet sterilization module 700. The ultraviolet sterilization module 700 is disposed in the housing 100 and is used to generate ultraviolet light to irradiate the humidifying module and an air path between the air inlet and the air outlet.

During use, the ultraviolet sterilization module 700 may generate ultraviolet rays when powered on, and the air path and relevant components of the humidifying device are comprehensively irradiated and sterilized by using the principle of ultraviolet sterilization, so as to achieve effective bacteriostasis and kill microorganisms in the air and an inner surface of the air path.

For the installation position of the ultraviolet sterilization module 700, the ultraviolet sterilization module 700 may be provided proximate to the air outlet 1002. Since the drying module 600 is provided at the air inlet 1001, it may effectively ensure that the air in the windward side of the wet membrane assembly 300 is fully and thoroughly dried during drying. In addition, the ultraviolet sterilization module 700 near the air outlet 1002 may be used to irradiate the leeward side of the wet membrane assembly 300, so as to achieve comprehensive and effective bacteriostasis.

In some embodiments, the structure of the ultraviolet sterilization module 700 may adopt the following form. The ultraviolet sterilization module 700 includes a second bracket 701 (e.g., an installation bracket) and light-emitting diodes (LEDs) 702.

The second bracket 701 is provided with a plurality of installation holes therein, and the LEDs 702 are disposed in the installation holes and used to generate ultraviolet light.

For example, the LEDs 702 adopt a short-wave ultraviolet-C (UVC) sterilization lamp group, which may generate ultraviolet rays to achieve sterilization. The LEDs 702 are fixedly installed inside the housing 100 by the second bracket 701, and the LEDs 702 are arranged proximate to the air outlet 1002.

The ultraviolet light emitted by the LEDs 702 is opposite to an output direction of the airflow, so as to reduce the ultraviolet rays irradiated from the air outlet 1002 to the outside. Thus, the second bracket 701 may be provided on the top of the housing 100, the second bracket 701 is obliquely provided with an installation panel, and the installation panel is provided with the installation holes therein, so that the LEDs 702 illuminates ultraviolet light toward the direction of the humidifying module.

A person skilled in the art will understand that the scope of disclosure involved in the present disclosure is not limited to the above specific embodiments and may modify and substitute some elements of the embodiments without departing from the concept of the present disclosure. The scope of the present disclosure is limited by the appended claims.

What is claimed is:

1. A humidifying device, comprising:

a housing including an air inlet, an air outlet, and an installation socket disposed at an end of the housing;

a humidifying module including a water receiving portion and a wet membrane assembly, wherein the wet membrane assembly is disposed in the water receiving portion, and the water receiving portion is disposed in the installation socket in a pluggable manner; the wet membrane assembly includes a water receiving tray on a top thereof, and the water receiving tray includes a plurality of first through holes; and a water spray module disposed above the wet membrane assembly, wherein the water spray module includes a water spray board, a water spray cover disposed on the water spray board, and a water inlet assembly connected with the water spray cover; a water storage chamber exits between the water spray board and the water spray cover; and the water spray board includes a plurality of second through holes; wherein the wet membrane assembly is located in the housing, and the wet membrane assembly is configured to humidify air entering from the air inlet and allow humidified air passing through the wet membrane assembly to be output through the air outlet;

the housing further includes a support plate, and a dimension of the support plate in a direction of a length of the housing is smaller than the length of the housing; and the water receiving portion includes a water tank and a decorative plate located at a bottom of the water tank, and a dimension of the decorative plate in a direction of a length of the water tank is smaller than the length of the water tank, wherein the support plate and the decorative plate are spliced together.

2. The humidifying device according to claim 1, wherein the wet membrane assembly includes:

a box body disposed in the water receiving portion and having an installation cavity, surfaces of the box body opposite to the air inlet and the air outlet being hollow structures; and a wet membrane located in the installation cavity and configured to absorb water to humidify the air passing through the wet membrane; wherein the water receiving tray is located on a top of the box body.

3. The humidifying device according to claim 1, wherein the housing further includes a first connecting portion located outside the installation socket, the water receiving portion includes a second connecting portion, and the second connecting portion is detachably connected to the first connecting portion.

4. The humidifying device according to claim 3, wherein the first connecting portion and the second connecting portion are snapped together; or the first connecting portion and the second connecting portion are screwed together.

5. The humidifying device according to claim 1, wherein the water receiving portion is drawably disposed in the installation socket; and the water receiving portion includes a side plate at an end thereof and a handle portion disposed on the side plate.

6. The humidifying device according to claim 5, further comprising an electric control box, wherein the water receiving portion further includes a drain pump configured to drain water in the water receiving portion; and the electric control box is electrically connected with the drain pump and configured to control operation of the drain pump.

7. The humidifying device according to claim 6, wherein the electric control box is rotatably disposed at the end of the housing; and the water receiving portion further includes a first locking portion disposed on the side plate, and the first locking portion is configured to lock the electric control box on the end of the water receiving portion.

8. The humidifying device according to claim 6, wherein the water receiving portion further includes a plug-in portion and a second locking portion that are located in the water tank; the plug-in portion and the second locking portion are located at both ends of the water tank; and the wet membrane assembly further includes a third matching portion and a recess portion; the third matching portion and the recess portion are located at both ends of the wet membrane assembly; wherein the third matching portion is connected with the plug-in portion, and the recess portion is matched with the second locking portion to fix the wet membrane assembly into the water receiving portion.

9. The humidifying device according to claim 1, wherein the housing further includes two sliding rails disposed on the support plate and opposite to each other; and the water receiving portion further includes first matching portions on both sides of the water tank; the first matching portions are slidably disposed on the corresponding sliding rails.

10. The humidifying device according to claim 9, wherein a sliding rail includes a straight portion, a guide portion located on a side of the straight portion proximate to the installation socket, and a second matching portion located on the straight portion; the guide portion extends obliquely toward the support plate relative to the straight portion; and a first matching portion corresponding to the sliding rail includes a limiting portion, and the limiting portion is connected to the corresponding second matching portion.

11. The humidifying device according to claim 1, wherein the water tank of the water receiving portion is overlapped on the support plate; or the decorative plate is overlapped on a free end of the support plate.

12. The humidifying device according to claim 1, wherein the housing further includes a top plate, a front plate, a rear plate, and a baffle plate between the front plate and the rear plate;

the air outlet is disposed in the front plate, and the air inlet is disposed in the rear plate; and the baffle plate is located on a side of both the air inlet and the air outlet away from the top plate; and the baffle plate has a through opening, and an opening of the through opening faces the installation socket.

13. The humidifying device according to claim 12, wherein the baffle plate includes a first portion proximate to the air inlet, a second portion proximate to the air outlet, a first rib plate connected to the first portion and extending upward, and a second rib plate connected to the second portion and extending upward;

the first rib plate is located at an edge of the first portion proximate to the through opening, and the second rib plate is located at an edge of the second portion proximate to the through opening; and a distance between a windward surface of the wet membrane assembly proximate to the air inlet and the first rib plate is smaller than a distance between a leeward surface of the wet membrane assembly proximate to the air outlet and the second rib plate.

14. The humidifying device according to claim 1, wherein the housing further includes an end plate, a sealing gasket disposed on the end plate, and an air deflector disposed on a side of the air inlet away from the end plate; and an end of the wet membrane assembly abuts against the sealing gasket, and the air deflector extends to another end of the wet membrane assembly.

15. The humidifying device according to claim 1, wherein the water receiving portion further includes a partition located in the water tank, and a water outlet and a drain pump that are connected to the water tank; and the water tank includes a main water tank and an auxiliary water tank that are independent; the partition is located between the main water tank and the auxiliary water tank, and a height of the partition is smaller than a height of a side wall of the water tank; wherein the water outlet is connected with the auxiliary water tank, and the drain pump is connected with the main water tank.

16. The humidifying device according to claim 1, wherein the air inlet and the air outlet are arranged opposite to each other, and the wet membrane assembly is located between the air inlet and the air outlet.

17. The humidifying device according to claim 1, further comprising:

a drying module disposed on the housing and proximate to the air inlet, the drying module being configured to heat the air entering the housing;

a first humidity sensor disposed at the air inlet and configured to detect humidity of air at the air inlet; and a second humidity sensor disposed at the air outlet and configured to detect humidity of air at the air outlet.

18. The humidifying device according to claim 1, further comprising:

an ultraviolet sterilization module disposed in the housing and configured to generate ultraviolet light to irradiate the humidifying module.

* * * * *